US008613832B2

(12) United States Patent
Nyander et al.

(10) Patent No.: US 8,613,832 B2
(45) Date of Patent: Dec. 24, 2013

(54) PROCESS FOR THE PRODUCTION OF PAPER

(75) Inventors: Johan Nyander, Sollentuna (SE); Fredrik Solhage, Borås (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 13/397,293

(22) Filed: Feb. 15, 2012

(65) Prior Publication Data

US 2012/0186765 A1 Jul. 26, 2012

Related U.S. Application Data

(62) Division of application No. 11/430,341, filed on May 9, 2006, now abandoned.

(60) Provisional application No. 60/681,487, filed on May 16, 2005.

(51) Int. Cl.

| | |
|---|---|
| ***D21H 17/43*** | (2006.01) |
| ***D21H 17/45*** | (2006.01) |
| ***D21H 17/68*** | (2006.01) |
| ***D21H 21/10*** | (2006.01) |

(52) U.S. Cl.

USPC ..... 162/168.3; 162/158; 162/164.6; 162/168.1; 162/168.2; 162/185; 162/181.1; 162/181.6

(58) Field of Classification Search

USPC ..... 162/158, 164.1, 164.6, 168.1–168.3, 162/181.1, 181.6, 181.7, 185; 106/600, 106/634, 636, 287.34; 524/492, 493, 500

See application file for complete search history.

(56) References Cited

U.S. PATENT DOCUMENTS

| | | | | | |
|---|---|---|---|---|---|
| 4,388,150 | A * | 6/1983 | Sunden et al. | 162/175 |
| 4,753,710 | A | 6/1988 | Langley et al. | 162/164.3 |
| 4,927,498 | A | 5/1990 | Rushmere | 162/168.3 |
| 4,954,220 | A | 9/1990 | Rushmere | 162/168.3 |
| 4,961,825 | A | 10/1990 | Andersson et al. | 162/175 |
| 4,980,025 | A | 12/1990 | Andersson et al. | |
| 5,071,512 | A | 12/1991 | Bixler et al. | 162/175 |
| 5,127,994 | A | 7/1992 | Johansson | 162/168.3 |
| 5,167,766 | A | 12/1992 | Honig et al. | 162/164.1 |
| 5,171,808 | A * | 12/1992 | Ryles et al. | 526/264 |
| 5,176,891 | A | 1/1993 | Rushmere | 423/328.1 |
| 5,368,833 | A | 11/1994 | Johansson et al. | 423/338 |
| 5,447,604 | A | 9/1995 | Johansson et al. | 162/181.6 |
| 5,470,435 | A | 11/1995 | Rushmere et al. | 162/181.6 |
| 5,543,014 | A | 8/1996 | Rushmere et al. | 162/181.6 |
| 5,571,494 | A | 11/1996 | Saastamoinen | 423/338 |
| 5,573,674 | A | 11/1996 | Lind et al. | 210/702 |
| 5,584,966 | A | 12/1996 | Moffett | 162/168.1 |
| 5,603,805 | A | 2/1997 | Andersson et al. | 162/168.3 |
| 5,607,552 | A | 3/1997 | Andersson et al. | 162/181.6 |
| 5,676,796 | A | 10/1997 | Cutts | |
| 5,688,482 | A | 11/1997 | Saastamoinen | 423/335 |
| 5,707,493 | A | 1/1998 | Saastamoinen | 162/164.1 |
| 6,083,348 | A | 7/2000 | Auhorn et al. | |
| 6,103,065 | A | 8/2000 | Humphreys et al. | 162/181.8 |
| 6,372,089 | B1 | 4/2002 | Keiser et al. | 162/181.6 |
| 6,444,091 | B1 * | 9/2002 | Ward et al. | 162/164.1 |
| 6,454,902 | B1 * | 9/2002 | Chen | 162/168.1 |
| 6,511,579 | B1 * | 1/2003 | Edwards et al. | 162/111 |
| 6,770,170 | B2 | 8/2004 | Covarrubias | 162/164.1 |
| 2002/0066540 | A1 * | 6/2002 | Chen et al. | 162/17 |
| 2002/0198306 | A1 * | 12/2002 | Carr et al. | 524/492 |
| 2003/0065041 | A1 * | 4/2003 | Keiser et al. | 516/82 |
| 2003/0168192 | A1 | 9/2003 | Mohammed | 162/158 |
| 2006/0142429 | A1 * | 6/2006 | Gelman et al. | 524/13 |
| 2006/0142430 | A1 * | 6/2006 | Harrington et al. | 524/13 |

FOREIGN PATENT DOCUMENTS

| | | | |
|---|---|---|---|
| EP | 0 234 513 | A1 | 9/1987 |
| EP | 0 235 893 | A1 | 9/1987 |
| EP | 0 335 575 | B1 | 10/1989 |
| EP | 0 790 351 | A2 | 8/1997 |
| EP | 0 790 351 | A3 | 8/1997 |
| EP | 1 238 161 | B1 | 9/2002 |
| EP | 1 460 041 | A2 | 9/2004 |
| EP | 1 460 041 | A3 | 9/2004 |
| EP | 1460041 | A2 * | 9/2004 |
| WO | WO 91/07543 | A1 | 5/1991 |
| WO | WO 95/33097 | A1 | 12/1995 |
| WO | WO 98/56715 | A1 | 12/1998 |
| WO | WO 00/06490 | A1 | 2/2000 |
| WO | WO 01/34910 | A1 | 5/2001 |
| WO | WO 02/33171 | A1 | 4/2002 |
| WO | WO 02/101145 | A1 | 12/2002 |
| WO | WO 03/056099 | A1 | 7/2003 |
| WO | WO 03/056100 | A1 | 7/2003 |
| WO | WO2004/015200 | A1 | 2/2004 |
| WO | WO 2005/116336 | A1 | 12/2005 |

OTHER PUBLICATIONS

Smook, Gary A., Handbook for Pulp and Paper Technologists, 2nd ed, Angus Wilde Publications, 1992, p. 229.*

(Continued)

*Primary Examiner* — Mark Halpern

*Assistant Examiner* — Dennis Cordray

(74) *Attorney, Agent, or Firm* — Robert C. Morriss

(57) ABSTRACT

The present invention relates to a drainage and retention aid composition which comprises:

(d) a first anionic component which is a water-soluble anionic organic polymer;

(e) a second anionic component which is a water-dispersible or branched anionic organic polymer; and (f) a third anionic component which is an anionic siliceous material;

wherein the first, second and third anionic components are present in a dry matter content of from 0.01 to 50% by weight.

22 Claims, No Drawings

(56) References Cited

OTHER PUBLICATIONS

Sears, Jr., G. W., "Determination of Specific Surface Area of Colloidal Silica by Titration with Sodium Hydroxide," Analytical Chem., vol. 28, No. 12 (1956), pp. 1981-1983.
Iler, R. K., et al., "Degree of Hydration of Particles of Colloidal Silica in Aqueous Solution, " J. Phys. Chem., vol. 60 (1956), pp. 955-957.
International Search Report Application No. PCT/SE2006/050090 dated Dec. 4, 2006.
English language translation of WO 2005/116336.
"Retention/drainage technology reduces chemical cost" Goliath Business News, 2005, 2 pages [online] Retrieved from the Internet [Retrieved Jul. 20, 2011].
"EKA NP Series Compozil retention systems", product sheet, Akzo Nobel Pulp and Paper/EKA Chemicals, no date, 2 pages [online] Retrieved from the Internet [Retrieved Jul. 20, 2011].
Definition of "colloid", Websters II New Riverside University Dictionary, Houghton Mifflin Company, 1988, p. 282.
Lai et al., "More effective retention system through new mixing technology and optimized residence time of the chemicals," The World Pulp and Paper Week, Jun. 2002, p. 200-205.
Stratton, R., "Effect of agitation on polymer additives," Tappi Journal, Mar. 1983, p. 141-144.
Sample tests Eka PL 1510 as to viscosity, charge density, conductivity, pH and moisture content, Orebro Kartong, 2003.
Product flyer for Eka PL 1510, 2000.

* cited by examiner

PROCESS FOR THE PRODUCTION OF PAPER

This application is a divisional of U.S. application Ser. No. 11/430,341, filed May 9, 2006 now abandoned, which claims priority based on U.S. Provisional Patent Application No. 60/681,487, filed May 16, 2005.

FIELD OF THE INVENTION

The present invention relates to a process for the production of paper and a composition comprising anionic components that is suitable for use as an additive in papermaking. More specifically, the invention relates to a process for the production of paper which comprises adding first, second and third anionic components to a cellulosic suspension after all points of high shear and dewatering the obtained suspension to form paper.

BACKGROUND OF THE INVENTION

In the art of papermaking, an aqueous suspension containing cellulosic fibres, and optional fillers and additives, is fed through pumps, screens and cleaners, which subject the stock to high shear forces, into a headbox which ejects the suspension onto a forming wire. Water is drained from the suspension through the forming wire so that a wet web of paper is formed on the wire, and the web is further dewatered and dried in the drying section of the paper machine. Drainage and retention aids are conventionally introduced at different points in the flow of suspension in order to facilitate drainage and increase adsorption of fine particles such as fine fibres, fillers and additives onto the cellulose fibres so that they are retained with the fibres on the wire. Examples of conventionally used drainage and retention aids include organic polymers, inorganic materials, and combinations thereof.

WO 98/56715 discloses aqueous polysilicate microgels, their preparation and use in papermaking and water purification. The polysilicate microgels can contain additional compounds, e.g. polymers containing carboxylic acid and sulphonic acid groups, such as polyacrylic acid.

WO 00/006490 discloses anionic nanocomposites for use as retention and drainage aids is papermaking prepared by adding an anionic polyelectrolyte to a sodium silicate solution and then combining the sodium silicate and polyelectrolyte solution with silicic acid.

U.S. Pat. No. 6,103,065 discloses a method for improving the retention and drainage of papermaking furnish comprising the steps of adding at least one cationic high charge density polymer of molecular weight 100,000 to 2,000,000 to said furnish after the last point of high shear; adding at least one polymer having a molecular weight greater than 2,000,000; and adding a swellable bentonite clay.

WO 01/34910 discloses a process for making paper or paper board in which a cellulosic suspension is flocculated by addition of a substantially water soluble polymer selected from (a) a polysaccharide or (b) a synthetic polymer of intrinsic viscosity at least 4 dl/g and then reflocculated by a subsequent addition of a reflocculating system comprising (i) a siliceous material and (ii) a substantially water soluble anionic polymer. Preferably, the substantially water soluble polymer is mixed into the cellulosic suspension causing flocculation and the flocculated suspension is then sheared, e.g. by passing it through one or more shear stages. The water soluble anionic polymeric reflocculating agent is preferably added late in the process, preferably after the last point of high shear, e.g. subsequent to the centri-screen. The process is claimed to provide improvements in retention and drainage.

WO 02/33171 discloses a process for making paper or paper board in which a cellulosic suspension is flocculated using a flocculating system comprising a siliceous material and organic microparticles which have an unswollen particle diameter of less than 750 nm.

WO 02/101145 discloses an aqueous composition comprising anionic organic polymeric particles and colloidal anionic silica-based particles, the anionic organic polymeric particles being obtainable by polymerising one or more ethylenically unsaturated monomers together with one or more polyfunctional branching agents and/or polyfunctional crosslinking agents. The composition is used as a flocculating agent in dewatering of suspended soils, in the treatment of water, wastewater and waste sludge, and as drainage and retention aid in the production of paper.

It would be advantageous to be able to provide a papermaking process with further improvements in drainage, retention and formation.

SUMMARY OF THE INVENTION

The present invention is directed to a process for producing paper which comprises:

(i) providing an aqueous suspension comprising cellulosic fibres, (ii) adding to the suspension after the last point of high shear:

(a) a first anionic component which is a water-soluble anionic organic polymer;

(b) a second anionic component which is a water-dispersible or branched anionic organic polymer having an unswollen particle size less than 1000 nm; and (c) a third anionic component which is an anionic siliceous material; and (iii) dewatering the obtained suspension to form paper.

The present invention is further directed to a process for producing paper which comprises:

(i) providing an aqueous suspension comprising cellulosic fibres, (ii) adding to the suspension after the last point of high shear:

(a) a first anionic component which is a water-soluble anionic organic polymer;

(b) a second anionic component which is a water-dispersible or branched anionic organic polymer; and (c) a third anionic component which is an anionic siliceous material comprising anionic silica-based polymer which comprises (I) aggregated anionic silica-based particles; or (II) silica-based particles having a specific surface area within the range of from 100 to 1700 m2/g (iii) dewatering the obtained suspension to form paper.

The present invention is further directed to a drainage and retention aid composition which comprises:

(a) a first anionic component which is a water-soluble anionic organic polymer;

(b) a second anionic component which is a water-dispersible or branched anionic organic polymer having an unswollen particle size of less than 1000 nm; and (c) a third anionic component which is an anionic siliceous material;

wherein the first, second and third anionic components are present in a dry matter content of from 0.01 to 50% by weight.

The present invention is further directed to a drainage and retention aid composition which comprises:

(a) a first anionic component which is a water-soluble anionic organic polymer;

(b) a second anionic component which is a water-dispersible or branched anionic organic polymer; and (c) a third anionic component which is an anionic siliceous material comprising anionic silica-based polymer which comprises (I) aggregated anionic silica-based particles; or (II) silica-based particles having a specific surface area within the range of from 100 to 1700 m2/g wherein the first, second and third anionic components are present in a dry matter content of from 0.01 to 50% by weight.

The present invention further relates to the use of the composition as a flocculating agent in the production of pulp and paper and for water purification.

DETAILED DESCRIPTION OF THE INVENTION

According to the present invention it has been found that drainage and retention can be improved without any significant impairment of formation, or even with improvements in paper formation, by a process which comprises adding three different anionic components, i.e., first, second and third anionic components, to an aqueous cellulosic suspension after the last point of high shear. Preferably, after the addition of the first, second and third anionic components, the obtained cellulosic suspension is fed into a headbox and ejected onto a wire where it is dewatered to form paper. Preferably, the cellulosic suspension is pre-treated by addition of a cationic material before addition of the first, second and third anionic components.

The present invention provides improvements in drainage and retention in the production of paper from all types of cellulosic suspensions, in particular suspensions containing mechanical or recycled pulp, and stocks having high contents of salts (high conductivity) and colloidal substances, and in papermaking processes with a high degree of white water closure, i.e. extensive white water recycling and limited fresh water supply. Hereby the present invention makes it possible to increase the speed of the paper machine and to use lower dosages of polymers to give corresponding drainage and/or retention effects, thereby leading to an improved papermaking process and economic benefits.

First Anionic Component

The first anionic component according to the invention is a water-soluble anionic organic polymer. Examples of suitable water-soluble anionic organic polymers include anionic polysaccharides and anionic synthetic organic polymers, preferably anionic synthetic organic polymers. Examples of suitable water-soluble anionic synthetic organic polymers include anionic aromatic condensation polymers and anionic vinyl addition polymers. Preferably, the water-soluble anionic organic polymer is substantially linear.

Examples of suitable water-soluble anionic polysaccharides include anionic starches, guar gums, cellulose derivatives, chitins, chitosans, glycans, galactans, glucans, xanthan gums, pectins, mannans, dextrins, preferably starches, guar gums and cellulose derivatives. Examples of suitable starches include potato, corn, wheat, tapioca, rice, waxy maize and barley, preferably potato.

Examples of suitable water-soluble anionic aromatic condensation polymers include anionic benzene-based and naphthalene-based condensation polymers, preferably naphthalene-sulphonic acid based and naphthalene-sulphonate based condensation polymers.

Examples of suitable water-soluble anionic synthetic organic polymers include anionic vinyl addition polymers obtained by polymerization of a water-soluble ethylenically unsaturated anionic or potentially anionic monomer or, preferably, a monomer mixture comprising one or more water-soluble ethylenically unsaturated anionic or potentially anionic monomers and, optionally, one or more other water-soluble ethylenically unsaturated monomers. The term "potentially anionic monomer", as used herein, is meant to include a monomer bearing a potentially ionisable group which becomes anionic when included in a polymer on application to the cellulosic suspension. Examples of suitable anionic and potentially anionic monomers include ethylenically unsaturated carboxylic acids and salts thereof, and ethylenically unsaturated sulphonic acids and salts thereof, e.g. (meth)acrylic acid and salts thereof, suitably sodium(meth) acrylate, ethylenically unsaturated sulphonic acids and salts thereof, e.g. 2-acrylamido-2-methylpropanesulphonate, sulphoethyl-(meth)acrylate, vinylsulphonic acid and salts thereof, styrenesulphonate, and paravinyl phenol (hydroxy styrene) and salts thereof. Preferably, the polymerization is carried out in the absence or substantial absence of crosslinking agent, thereby forming substantially linear anionic synthetic organic polymers.

The monomer mixture can contain one or more water-soluble ethylenically unsaturated non-ionic monomers. Examples of suitable copolymerizable non-ionic monomers include acrylamide and acrylamide-based monomers, e.g. methacrylamide, N-alkyl(meth)acrylamides, e.g. N-methyl (meth)acrylamide, N-ethyl(meth)acrylamide, N-n-propyl (meth)acrylamide, N-isopropyl(meth)acrylamide, N-n-butyl (meth)acrylamide, N-t-butyl(meth)acrylamide and N-isobutyl(meth)acrylamide; N-alkoxyalkyl(meth)acrylamides, e.g. N-n-butoxymethyl(meth)acrylamide, and N-isobutoxymethyl(meth)acrylamide; N,N-dialkyl(meth) acrylamides, e.g. N,N-dimethyl(meth)acrylamide; dialkylaminoalkyl(meth)acrylamides; acrylate-based monomers like dialkylaminoalkyl(meth)acrylates; and vinyl amines. The monomer mixture can also contain one or more water-soluble ethylenically unsaturated cationic or potentially cationic monomers, preferably in minor amounts if present. The term "potentially cationic monomer", as used herein, is meant to include a monomer bearing a potentially ionisable group which becomes cationic when included in a polymer on application to the cellulosic suspension. Examples of suitable cationic monomers include those represented by the below-mentioned general structural formula (I), and diallyldialkyl ammonium halides, e.g. diallyldimethyl ammonium chloride. Examples of preferred copolymerizable monomers include (meth)acrylamide, and examples of preferred first anionic components include anionic acrylamide-based polymer.

The first anionic component according to the invention can have a weight average molecular weight of at least about 2,000, suitably at least 10,000. For anionic aromatic condensation polymers, the weight average molecular weight is usually at least about 2,000, suitably at least 10,000. For anionic vinyl addition polymers, the weight average molecular weight is usually at least 500,000, suitably at least about 1 million, preferably at least about 2 million and more preferably at least about 5 million. The upper limit is not critical; it can be about 300 million, usually 50 million and suitably 30 million.

The first anionic component according to the invention usually has a charge density less than about 10 meq/g, suitably less than about 6 meq/g, preferably less than about 4 meq/g, more preferably less than 2 meq/g. Suitably, the charge density is in the range of from 0.5 to 10.0, preferably from 1.0 to 4.0 meq/g.

Second Anionic Component

The second anionic component according to the invention is a water-dispersible or branched anionic organic polymer. Preferably, the second anionic component is a synthetic anionic organic polymer. Examples of suitable water-dispersible anionic organic polymers include crosslinked anionic organic polymers and non-crosslinked water-insoluble anionic organic polymers. Examples of suitable branched anionic organic polymers include water-soluble anionic organic polymers.

Examples of suitable water-dispersible and branched anionic organic polymers include the crosslinked and branched polymers obtained by polymerization of a monomer mixture comprising one or more ethylenically unsaturated anionic or potentially anionic monomers and, optionally, one or more other ethylenically unsaturated monomers, in the presence of one or more polyfunctional crosslinking agents. Preferably, the ethylenically unsaturated monomers are water-soluble. The presence of a polyfunctional crosslinking agent in the monomer mixture renders possible preparation of branched polymers, slightly crosslinked polymers and highly crosslinked polymers that are water-dispersible.

Examples of suitable anionic and potentially anionic monomers include ethylenically unsaturated carboxylic acids and salts thereof, ethylenically unsaturated sulphonic acids and salts thereof, e.g. any one of those mentioned above. Examples of suitable polyfunctional crosslinking agents include compounds having at least two ethylenically unsaturated bonds, e.g. N,N-methylene-bis(meth)acrylamide, polyethyleneglycol di(meth)acrylate, N-vinyl(meth)acrylamide, divinylbenzene, triallylammonium salts and N-methylallyl(meth)acrylamide; compounds having an ethylenically unsaturated bond and a reactive group, e.g. glycidyl(meth) acrylate, acrolein and methylol(meth)acrylamide; and compounds having at least two reactive groups, e.g. dialdehydes like glyoxal, diepoxy compounds and epichlorohydrin.

The monomer mixture can contain one or more water-soluble ethylenically unsaturated non-ionic monomers. Examples of suitable copolymerizable non-ionic monomers include acrylamide and the above-mentioned non-ionic acrylamide-based and acrylate-based monomers and vinyl amines. The monomer mixture can also contain one or more water-soluble ethylenically unsaturated cationic or potentially cationic monomers, preferably in minor amounts if present. Examples of suitable copolymerizable cationic monomers include the monomers represented by the above general structural formula (I) and diallyldialkyl ammonium halides, e.g. diallyldimethyl ammonium chloride.

Suitable water-dispersible and branched anionic organic polymers can be prepared using at least 4 molar parts per million of polyfunctional crosslinking agent based on monomer present in the monomer mixture, or based on monomeric units present in the polymer, preferably from about 4 to about 6,000 molar parts per million, most preferably from 20 to 4,000.

Examples of preferred water-dispersible or branched anionic organic polymer include water-dispersible and branched anionic acrylamide-based polymers.

Examples of suitable non-crosslinked water-insoluble anionic organic polymers include the polymers obtained by polymerization of a monomer mixture comprising one or more water-insoluble monomers, one or more ethylenically unsaturated anionic or potentially anionic monomers and, optionally, one or more other ethylenically unsaturated monomers. Examples of suitable water-insoluble monomers include styrene and styrene-based monomers, alkenes, e.g. ethylene, propylene, butylenes, etc. Examples of suitable anionic and potentially anionic monomers include ethylenically unsaturated carboxylic acids and salts thereof, ethylenically unsaturated sulphonic acids and salts thereof, e.g. any one of those mentioned above.

Suitable water-dispersible anionic organic polymer have an unswollen particle size of less than about 1,500 nm in diameter, suitably less than about 1,000 nm and preferably less than about 950 nm. Examples of suitable water-dispersible and branched anionic organic polymers include those disclosed in U.S. Pat. No. 5,167,766, which is hereby incorporated herein by reference.

Third Anionic Component

The third anionic component according to the invention is an anionic siliceous material. Examples of suitable anionic siliceous materials include anionic inorganic polymers based on silicic acid and silicates, i.e., anionic silica-based polymers, and clays of smectite type, preferably anionic polymers based on silicic acid or silicates.

Suitable anionic silica-based polymers can be prepared by condensation polymerisation of siliceous compounds, e.g. silicic acids and silicates, which can be homopolymerised or co-polymerised. Preferably, the anionic silica-based polymers comprise anionic silica-based particles that are in the colloidal range of particle size. Anionic silica-based particles are usually supplied in the form of aqueous colloidal dispersions, so-called aqueous sols. The silica-based sols can be modified and contain other elements, e.g. aluminium, boron, nitrogen, zirconium, gallium and titanium, which can be present in the aqueous phase and/or in the silica-based particles. Examples of suitable anionic silica-based particles include polysilicic acids, polysilicic acid microgels, polysilicates, polysilicate microgels, colloidal silica, colloidal aluminium-modified silica, polyaluminosilicates, polyaluminosilicate microgels, polyborosilicates, etc. Examples of suitable anionic silica-based particles include those disclosed in U.S. Pat. Nos. 4,388,150; 4,927,498; 4,954,220; 4,961,825; 4,980,025; 5,127, 994; 5,176, 891; 5,368,833; 5,447,604; 5,470,435; 5,543,014; 5,571,494; 5,573,674; 5,584,966; 5,603,805; 5,688,482; and 5,707,493; which are hereby incorporated herein by reference.

Examples of suitable anionic silica-based particles include those having an average particle size below about 100 nm, preferably below about 20 nm and more preferably in the range of from about 1 to about 10 nm. As conventional in the silica chemistry, the particle size refers to the average size of the primary particles, which may be aggregated or non-aggregated. Preferably, the anionic silica-based polymer comprises aggregated anionic silica-based particles. The specific surface area of the silica-based particles is suitably at least 50 $m^2/g$ and preferably at least 100 $m^2/g$. Generally, the specific surface area can be up to about 1700 $m^2/g$ and preferably up to 1000 $m^2/g$. The specific surface area is measured by means of titration with NaOH as described by G.W. Sears in Analytical Chemistry 28(1956): 12, 1981-1983 and in U.S. Pat. No. 5,176,891 after appropriate removal of or adjustment for any compounds present in the sample that may disturb the titration like aluminium and boron species. The given area thus represents the average specific surface area of the particles.

In a preferred embodiment of the invention, the anionic silica-based particles have a specific surface area within the range of from 50 to 1000 $m^2/g$, more preferably from 100 to 950 $m^2/g$. Preferably, the silica-based particles are present in a sol having a S-value in the range of from 8 to 50%, preferably from 10 to 40%, containing silica-based particles with a specific surface area in the range of from 300 to 1000 $m^2/g$, suitably from 500 to 950 $m^2/g$, and preferably from 750 to 950 $m^2/g$, which sols can be modified as mentioned above. The S-value is measured and calculated as described by Iler & Dalton in J. Phys. Chem. 60(1956), 955-957. The S-value indicates the degree of aggregation or microgel formation and a lower S-value is indicative of a higher degree of aggregation.

In yet another preferred embodiment of the invention, the silica-based particles have a high specific surface area, suitably above about 1000 $m^2/g$. The specific surface area can be in the range of from 1000 to 1700 $m^2/g$ and preferably from 1050 to 1600 $m^2/g$.

Examples of suitable clays of smectite type include naturally occurring, synthetic and chemically treated materials, e.g. montmorillonite, bentonite, hectorite, beidelite, nontronite, saponite, sauconite, hormonite, attapulgite and sepiolite, preferably bentonite. Suitable clays include those disclosed in U.S. Pat. Nos. 4,753,710; 5,071,512; and 5,607,552, which are hereby incorporated herein by reference.

Additional Components

It may be desirable to further include additional components in the process of the present invention. Preferably, these components are added to the cellulosic suspension before it is passed through the last point of high shear, and these components can be added to the thick cellulosic suspension or to the thin cellulosic suspension which can be obtained by mixing the thick cellulosic suspension with fresh water and/or recirculated white water.

According to a preferred aspect of the invention, the process comprises adding a cationic material to the cellulosic suspension before the last point of high shear. Examples of suitable cationic materials include cationic organic polymers and cationic inorganic materials. Examples of suitable cationic organic polymers include cationic polysaccharides, cationic synthetic polymers and cationic organic flocculants. Examples of suitable cationic inorganic materials include cationic inorganic coagulants.

Examples of suitable cationic polysaccharides include cationic starches, guar gums, cellulose derivatives, chitins, chitosans, glycans, galactans, glucans, xanthan gums, pectins, mannans, dextrins, preferably starches, guar gums and cellulose derivatives. Examples of suitable starches include potato, corn, wheat, tapioca, rice, waxy maize and barley, preferably potato.

Examples of suitable cationic synthetic polymers include water-soluble high molecular weight cationic synthetic organic polymers, e.g. cationic acrylamide-based polymers; poly(diallyldialkyl ammonium halides), e.g. poly(diallyldimethyl ammonium chloride); polyethylene imines; polyamidoamines; polyamines; and vinylamine-based polymers. Examples of suitable water-soluble high molecular weight cationic synthetic organic polymers include polymers prepared by polymerization of a water-soluble ethylenically unsaturated cationic or potentially cationic monomer or, preferably, a monomer mixture comprising one or more water-soluble ethylenically unsaturated cationic or potentially cationic monomers and optionally one or more other water-soluble ethylenically unsaturated monomers.

Examples of suitable water-soluble ethylenically unsaturated cationic monomers include diallyldialkyl ammonium halides, e.g. diallyldimethyl ammonium chloride and cationic monomers represented by the general structural formula (I):

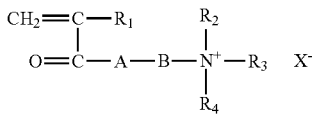

(I)

wherein $R_1$ is H or $CH_3$; $R_2$ and $R_3$ are each H or, preferably, a hydrocarbon group, suitably alkyl, having from 1 to 3 carbon atoms, preferably 1 to 2 carbon atoms; A is O or NH; B is an alkyl or alkylene group having from 2 to 8 carbon atoms, suitably from 2 to 4 carbon atoms, or a hydroxy propylene group; $R_4$ is H or, preferably, a hydrocarbon group, suitably alkyl, having from 1 to 4 carbon atoms, preferably 1 to 2 carbon atoms, or a substituent containing an aromatic group, suitably a phenyl or substituted phenyl group, which can be attached to the nitrogen by means of an alkylene group usually having from 1 to 3 carbon atoms, suitably 1 to 2 carbon atoms, suitable $R_4$ including a benzyl group ($—CH_2—C_6H_5$); and $X^-$ is an anionic counterion, usually a halide like chloride.

Examples of suitable monomers represented by the general structural formula (I) include quaternary monomers obtained by treating dialkylaminoalkyl(meth)acrylates, e.g. dimethylaminoethyl(meth)acrylate, diethylaminoethyl(meth)acrylate and dimethylaminohydroxypropyl(meth)acrylate, and dialkylaminoalkyl(meth)acrylamides, e.g. dimethylaminoethyl(meth)acrylamide, diethylaminoethyl(meth)acrylamide, dimethylaminopropyl(meth)acrylamide, and diethylaminopropyl(meth)acrylamide, with methyl chloride or benzyl chloride. Preferred cationic monomers of the general formula (I) include dimethylaminoethyl acrylate methyl chloride quaternary salt, dimethylaminoethyl methacrylate methyl chloride quaternary salt, dimethylaminoethyl acrylate benzyl chloride quaternary salt and dimethylaminoethyl methacrylate benzyl chloride quaternary salt.

The monomer mixture can contain one or more water-soluble ethylenically unsaturated non-ionic monomers. Examples of suitable non-ionic monomers include acrylamide and the above-mentioned non-ionic acrylamide-based and acrylate-based monomers and vinyl amines. The monomer mixture can also contain one or more water-soluble ethylenically unsaturated anionic or potentially anionic monomers, preferably in minor amounts if present. Examples of suitable copolymerizable anionic and potentially anionic monomers include ethylenically unsaturated carboxylic acids and salts thereof, and ethylenically unsaturated sulphonic acids and salts thereof, e.g. any one of those mentioned above. Examples of preferred copolymerizable monomers include acrylamide and methacrylamide, i.e. (meth)acrylamide, and examples of preferred high molecular weight cationic synthetic organic polymers include cationic acrylamide-based polymer.

The high molecular weight cationic synthetic organic polymers can have a weight average molecular weight of at least 500,000, suitably at least about 1 million and preferably above about 2 million. The upper limit is not critical; it can be about 30 million, usually 20 million.

Examples of suitable cationic organic coagulants include cationic polyamines, polyamideamines, polyethylene imines, dicyandiamide condensation polymers and low molecular weight highly cationic vinyl addition polymers. Examples of suitable cationic inorganic coagulants include aluminium compounds like alum and polyaluminium compounds, e.g. polyaluminium chlorides.

Addition of Components

According to the present invention, the first, second and third anionic components are added to the aqueous cellulosic suspension after it has passed through all stages of high mechanical shear and prior to drainage. Examples of high mechanical shear stages include pumping and cleaning stages. For instance, such shearing stages are included when the cellulosic suspension is passed through fan pumps, pressure screens and centri-screens. Suitably, the last point of high shear occurs at a centri-screen and, consequently, the first, second and third anionic components are suitably added to the cellulosic suspension subsequent to the centri-screen. Preferably, after addition of the first, second and third anionic components the cellulosic suspension is fed into the headbox of the paper machine which ejects the suspension onto the forming wire for drainage.

The first, second and third anionic components can be separately or simultaneously added to the cellulosic suspension. When separately adding the components, they can be added in any order. Suitably, the first anionic component is added prior to adding the second and third anionic components, the second component can be added prior to, simultaneously with or after the third component. Alternatively, the first anionic component is suitably added to the cellulosic suspension simultaneously with the second anionic component and then the third anionic component is added.

When simultaneously adding the components, the first, second and third anionic components can be added separately and/or in the form of a mixture. Examples of suitable simultaneous additions include adding the three components separately, and adding one of the components separately and two of the components in the form of a mixture. The present invention further relates to a composition comprising the above-mentioned first, second and third components and the use thereof. Suitably, the composition is used as a flocculating agent in the production of pulp and paper and for water purification. Preferably, the composition is used as a drainage and retention aid in papermaking, optionally in combination with a cationic material, e.g. any one of the cationic materials disclosed herein. Preferably, the composition is aqueous and the first, second and third anionic components can be present in a dry matter content of from 0.01 to 50% by weight, suitably from 0.1 to 30% by weight. The first ($1^{st}$), second ($2^{nd}$) and third ($3^{rd}$) anionic components can be present in the composition in a weight ratio $1^{st}$:2nd:3rd of 0.05-10:0.05-10:1, preferably 0.1-2:0.1-2:1. The composition according to the invention can be easily prepared by mixing the first, second and third components, preferably under stirring.

The first, second and third anionic components according to the invention can be added to the cellulosic suspension to be dewatered in amounts which can vary within wide limits. Generally, the first, second and third anionic components are added in amounts that give better drainage and retention than is obtained when not adding the polymers. The first anionic component is usually added in an amount of at least about 0.001% by weight, often at least about 0.005% by weight, calculated as dry polymer on dry cellulosic suspension, and the upper limit is usually about 2.0 and suitably about 1.5% by weight. Likewise, the second anionic component is usually added in an amount of at least about 0.001% by weight, often at least about 0.005% by weight, calculated as dry polymer on dry cellulosic suspension, and the upper limit is usually about 2.0 and suitably about 1.5% by weight. Similarly, the third anionic component is usually added in an amount of at least about 0.001% by weight, often at least about 0.005% by weight, calculated as dry additive (usually dry $SiO_2$ or dry clay) on dry cellulosic suspension, and the upper limit is usually about 2.0 and suitably about 1.5% by weight. When using the composition according to the invention, it is usually added in an amount of at least about 0.003% by weight, often at least about 0.005% by weight, calculated as dry matter on dry cellulosic suspension, and the upper limit is usually about 5.0 and suitably about 3.0% by weight.

When using a cationic material in the process, such a material can be added in an amount of at least about 0.001% by weight, calculated as dry material on dry cellulosic suspension. Suitably, the amount is in the range of from about 0.05 up to about 3.0%, preferably in the range from about 0.1 up to about 2.0%.

The process of this invention is applicable to all papermaking processes and cellulosic suspensions, and it is particularly useful in the manufacture of paper from a stock that has a high conductivity. In such cases, the conductivity of the stock that is dewatered on the wire is usually at least about 1.0 mS/cm, preferably at least 3.0 mS/cm, and more preferably at least 5.0 mS/cm. Conductivity can be measured by standard equipment such as, for example, a WTW LF 539 instrument supplied by Christian Berner.

The present invention further encompasses papermaking processes where white water is extensively recycled, or recirculated, i.e. with a high degree of white water closure, for example where from 0 to 30 tons of fresh water are used per ton of dry paper produced, usually less than 20, preferably less than 15, more preferably less than 10 and notably less than 5 tons of fresh water per ton of paper. Fresh water can be introduced in the process at any stage; for example, fresh water can be mixed with cellulosic fibres in order to form a cellulosic suspension, and fresh water can be mixed with a thick cellulosic suspension to dilute it so as to form a thin cellulosic suspension to which the first, second and third anionic components are subsequently added.

The process according to the invention is used for the production of paper. The term "paper", as used herein, of course include not only paper and the production thereof, but also other web-like products, such as for example board and paperboard, and the production thereof. The process can be used in the production of paper from different types of suspensions of cellulosic fibres, and the suspensions should preferably contain at least 25% and more preferably at least 50% by weight of such fibres, based on dry substance. The suspensions can be based on fibres from chemical pulp, such as sulphate and sulphite pulp, thermo-mechanical pulp, chemo-thermomechanical pulp, organosolv pulp, refiner pulp or groundwood pulp from both hardwood and softwood, or fibres derived from one year plants like elephant grass, bagasse, flax, straw, etc., and can also be used for suspensions based on recycled fibres. The invention is preferably applied to processes for making paper from wood-containing suspensions.

The suspension also contain mineral fillers of conventional types, such as, for example, kaolin, clay, titanium dioxide, gypsum, talc and both natural and synthetic calcium carbonates, such as, for example, chalk, ground marble, ground calcium carbonate, and precipitated calcium carbonate. The stock can of course also contain papermaking additives of conventional types, such as wet-strength agents, sizing agents, such as those based on rosin, ketene dimers, ketene multimers, alkenyl succinic anhydrides, etc.

Preferably the invention is applied on paper machines producing wood-containing paper and paper based on recycled fibres, such as SC, LWC and different types of book and newsprint papers, and on machines producing wood-free printing and writing papers, the term wood-free meaning less than about 15% of wood-containing fibres. Examples of preferred applications of the invention include the production of paper and layer of multilayered paper from cellulosic suspensions containing at least 50% by weight of mechanical and/or recycled fibres. Preferably the invention is applied on paper machines running at a speed of from 300 to 3000 m/min and more preferably from 500 to 2500 m/min.

The invention is further illustrated in the following example which, however, is not intended to limit the same.

Parts and % relate to parts by weight and % by weight, respectively, unless otherwise stated.

Example 1

The following components were used in the examples to illustrate the present invention:

A1: Water-soluble anionic acrylamide-based polymer prepared by polymerisation of acrylamide (80 mole %) and acrylic acid (20 mole %), the polymer having a weight average molecular weight of about 12 million and anionic charge density of about 2.6 meq/g.

A2: Water-dispersible crosslinked anionic acrylamide-based polymer prepared by polymerisation of acrylamide (30 mole %), acrylic acid (70 mole %) in he presence of N,N-methylene-bis(meth)acrylamide as a crosslinking agent (350 ppm), the polymer having an anionic charge density of about 8.5 meq/g.

A3: Anionic inorganic condensation polymer of silicic acid in the form of colloidal aluminium-modified silica sol having an S-value of about 21 and containing silica-based particles with a specific surface area of about 800 $m^2/g$.

A123: A mixture of the above A1, A2 and A3 in a dry weight ratio A1:A2:A3 of 0.2:0.2:1.

C1: Cationic polyaluminium chloride with a cationic charge density of about 8.0 meqv/g.

C2: Cationic acrylamide-based polymer prepared by polymerisation of acrylamide (90 mole %) and acryloxyethyltrimethyl ammonium chloride (10 mole %), the polymer having a weight average molecular weight of about 6 million and cationic charge density of about 1.2 meq/g.

C3: Cationic acrylamide-based polymer prepared by polymerisation of acrylamide (60 mole %) and acryloxyethyltrimethyl ammonium chloride (40 mole %), the polymer having a weight average molecular weight of about 3 million and cationic charge of about 3.3 meq/g.

C4: Cationic starch prepared by treating native starch with 2,3-hydroxypropyl trimethyl ammonium chloride to achieve D.S. 0.11, the polymer having a cationic charge density of about 0.6 meq/g.

Example 2

Drainage performance was evaluated by means of a Dynamic Drainage Analyser (DDA), available from Akribi, Sweden, which measures the time for draining a set volume of cellulosic suspension through a wire when removing a plug and applying vacuum to that side of the wire opposite to the side on which the cellulosic suspension is present.

Retention performance was evaluated by means of a nephelometer, available from Novasina, Switzerland, by measuring the turbidity of the filtrate, the white water, obtained by draining the cellulosic suspension. The turbidity was measured in NTU (Nephelometric Turbidity Units).

The cellulosic suspension used in the test was based on 75% TMP and 25% DIP fibre material and bleach water from a newsprint mill. Consistency was 0.60%, pH was 7.4 and conductivity of the cellulosic suspension was 1.5 mS/cm.

In order to simulate additions before and after the last points of high shear, the cellulosic suspension was stirred in a baffled jar at different stirrer speeds. The stirring and creation of high shear conditions were made according to the following:

(i) stirring at 1000 rpm for 25 seconds;
(ii) stirring at 2000 rpm for 10 seconds;
(iii) stirring at 1000 rpm for 15 seconds; and
(iv) dewatering the stock.

Additions to the cellulosic suspension were made as follows (addition levels in kg/t): Additions, if any, were made 45, 25, 15, 10 and 5 seconds prior to dewatering, corresponding to the additions designated Add. 45, Add. 25, Add. 15, Add. 10 and Add. 5, respectively, of Table 1. The additions designated Add. 15, Add. 10 and Add. 5 were accordingly made after the last point of high shear.

Table 1 shows the drainage (dewatering) and retention effect observed. In Table 1, Drain. Time means drainage (dewatering) time and Turb. means turbidity. The addition levels are given as dry additive (calculated as dry polymer, dry $Al_2O_3$ and dry $SiO_2$) on dry cellulosic suspension.

Test No. 1 shows the result without any additives. Test Nos. 2 to 4 illustrate processes employing additives used for comparison and Test Nos. 5 to 15 illustrate processes according to the invention.

TABLE 1

| Test No. | Add. 45 | Add. 25 | Add. 15 | Add. 10 | Add. 5 | Addition Levels at Add. 45/Add. 25/ Add. 15/Add. 10/ Add. 5 [kg/t] | Drain. Time [s] | Turb. [NTU] |
|---|---|---|---|---|---|---|---|---|
| 1 | — | — | — | — | — | —/—/—/—/— | 65.1 | 202 |
| 2 | C1 | A2 | A1 | A3 | — | 2/0.1/0.1/0.5/— | 51.3 | 128 |
| 3 | C1 | A3 | A1 | — | A2 | 2/0.5/0.1/—/0.1 | 41.0 | 110 |
| 4 | C1 | A1 | — | A3 | A2 | 2/0.1/—/0.5/0.1 | 43.3 | 150 |
| 5 | C1 | — | A1 | A3 | A2 | 2/—/0.1/0.5/0.1 | 39.7 | 126 |
| 6 | — | C2 | A1 | A3 | A2 | —/1.5/0.1/0.5/0.1 | 36.3 | 95 |
| 7 | — | C2 | A1 | A3 | A2 | —/2/0.1/0.5/0.1 | 21.8 | 65 |
| 8 | — | C2 | A1 | A2 | A3 | —/2/0.1/0.1/0.5 | 18.1 | 69 |
| 9 | — | C2 | A2 | A1 | A3 | —/2/0.1/0.5/0.1 | 18.3 | 69 |
| 10 | — | C2 | A2 | A3 | A1 | —/2/0.1/0.5/0.1 | 33.5 | 76 |
| 11 | — | C2 | A3 | A1 | A2 | —/2/0.5/0.1/0.1 | 19.9 | 67 |
| 12 | — | C2 | A3 | A2 | A1 | —/2/0.5/0.1/0.1 | 25.7 | 67 |
| 13 | — | C2 | A1 + A2 + A3 | — | — | —/2/0.1 + 0.5 + 0.1/—/— | 20.5 | 65 |
| 14 | — | C2 | — | A1 + A2 + A3 | — | —/2/—/0.1 + 0.5 + 0.1/— | 18.5 | 70 |
| 15 | — | C2 | — | — | A1 + A2 + A3 | —/2/—/—/0.1 + 0.5 + 0.1 | 17.3 | 67 |

As is evident from Table 1, the processes according to the invention provided improved drainage and retention performance in view of the comparative processes.

Example 3

Drainage performance was evaluated using the procedure according to Example 2. The cellulosic suspension used in the tests was based on 75% TMP and 25% DIP fibre material and bleach water from a newsprint mill. Consistency was 0.94%, pH was 7.1 and conductivity of the cellulosic suspension was 1.4 mS/cm.

Table 2 shows the drainage (dewatering) effect observed. The addition levels are given as dry additive (calculated as dry polymer and dry $SiO_2$) on dry cellulosic suspension.

Test No. 1 shows the result without any additives. Test Nos. 2 to 7 illustrate processes employing additives used for comparison and Test Nos. 8 to 10 illustrate processes according to the invention. In Test No. 9, the components A1, A2 and A3 were separately added 10 seconds prior to dewatering. In Test No. 10, the components A2 and A3 were separately added 5 seconds prior to dewatering.

TABLE 2

| Test No. | Add. 45 | Add. 25 | Add. 15 | Add. 10 | Add. 5 | Addition Levels at Add. 45/Add. 25/ Add. 15/Add. 10/ Add. 5 [kg/t] | Drain. Time [s] |
|---|---|---|---|---|---|---|---|
| 1 | — | — | — | — | — | —/—/—/—/— | 71.8 |
| 2 | — | C2 | — | — | — | —/1/—/—/ | 33.2 |
| 3 | C3 | C2 | — | — | — | 0.5/1/—/—/— | 26.1 |
| 4 | C3 | C2 | — | — | A3 | 1/1/—/—/0.1 | 14.3 |
| 5 | C3 | C2 | A1 | A2 | — | 1/1/0.1/0.1/— | 14.2 |
| 6 | C3 | C2 | A1 | — | A3 | 1/1/0.1/—/0.1 | 12.5 |
| 7 | C3 | C2 | — | A2 | A3 | 1/1/—/0.1/0.1 | 10.2 |
| 8 | C3 | C2 | A1 | A2 | A3 | 1/1/0.1/0.1/0.1 | 10.0 |
| 9 | C3 | C2 | — | A1 + A2 + A3 | — | 1/1/—/0.1 + 0.1 + 0.1/— | 9.5 |
| 10 | C3 | C2 | A1 | — | A2 + A3 | 1/1/0.1/—/0.2 + 0.1 | 9.3 |

As is evident from Table 2 the processes according to the invention provided improved drainage and retention performance in view of the comparative processes.

Example 4

Retention performance was evaluated using the procedure of Example 2. The cellulosic suspension used in the tests was based on 75% TMP and 25% DIP fibre material and bleach water from a newsprint mill. Consistency was 0.61%, pH was 7.7 and conductivity of the cellulosic suspension was 1.6 mS/cm.

Table 3 shows the retention effect observed. The addition levels are given as dry additive (calculated as dry polymer and dry $SiO_2$) on dry cellulosic suspension.

Test No. 1 shows the result without any additives. Test Nos. 2 to 11 illustrate processes employing additives used for comparison and Test Nos. 12 to 15 illustrate processes according to the invention. In Test No. 13, the components A1, A2 and A3 were separately added 10 seconds prior to dewatering. In Test Nos. 14 and 15, the components A1, A2 and A3 were pre-mixed to form the component A123 which was added 10 and 5 seconds, respectively, prior to dewatering.

TABLE 3

| Test No. | Add. 45 | Add. 25 | Add. 15 | Add. 10 | Add. 5 | Addition Levels at Add. 45/Add. 25/ Add. 15/Add. 10/ Add. 5 [kg/t] | Turb. [NTU] |
|---|---|---|---|---|---|---|---|
| 1 | — | — | — | — | — | —/—/—/—/— | 143 |
| 2 | C3 | C4 | — | — | A3 | 0.5/5/—/—/1 | 80 |
| 3 | C3 | C4 | A1 | — | — | 0.5/5/0.2/—/— | 84 |
| 4 | C3 | C4 | — | A2 | — | 0.5/5/—/0.2/— | 76 |
| 5 | C3 | C4 | A1 | — | A3 | 0.5/5/0.2/—/1 | 76 |
| 6 | C3 | C4 | — | A2 | A3 | 0.5/5/—/0.2/1 | 68 |
| 7 | C3 | C4 | A1 | A2 | — | 0.5/5/0.2/0.2/— | 69 |
| 8 | C3 | C4 | A1 | — | — | 0.5/5/0.4/—/— | 79 |
| 9 | C3 | C4 | — | A2 | — | 0.5/5/—/0.4/— | 71 |
| 10 | C3 | C4 | A1 | — | A3 | 0.5/5/0.1/—/1 | 77 |
| 11 | C3 | C4 | — | A2 | A3 | 0.5/5/—/0.4/1 | 70 |
| 12 | C3 | C4 | A1 | A2 | A3 | 0.5/5/0.2/0.2/1 | 64 |
| 13 | C3 | C4 | — | A1 + A2 + A3 | — | 0.5/5/—/0.2 + 0.2 + 1/— | 64 |
| 14 | C3 | C4 | — | A123 | — | 0.5/5/—/0.2 + 0.2 + 1/— | 64 |
| 15 | C3 | C4 | — | — | A123 | 0.5/5/—/—/0.2 + 0.2 + 1 | 65 |

As is evident from Table 3, the processes according to the invention provided improved drainage and retention performance in view of the comparative processes.

The invention claimed is:

1. A process for producing paper which comprises:

(i) providing an aqueous suspension comprising cellulosic fibres, (ii) adding to the suspension after the last point of high shear and subsequent a centri-screen:

(a) a first anionic component which is a water-soluble anionic acrylamide-based polymer;

(b) a second anionic component which is a water-dispersible or branched acrylamide-based polymer;

(c) a third anionic component which is an anionic siliceous material comprising an anionic silica-based polymer comprising anionic silica-based particles having a specific surface area within the range of from 100 to 1700 m2/g;

(iii) dewatering the obtained suspension to form paper.

2. The process of claim 1, wherein the cellulosic suspension after addition of the first, second and third anionic components is fed into a headbox of a paper machine, the headbox ejecting the suspension onto a forming wire for drainage.

3. The process of claim 1, wherein the first anionic component has a molecular weight of at least 500,000.

4. The process of claim 1, wherein the silica-based particles are present in a sol having an S-value in the range of from 8 to 50%.

5. The process of claim 1, wherein the second anionic component has an unswollen particle size less than 950 nm.

6. The process of claim 1, wherein the second anionic component is a water-dispersible and branched acrylamide-based polymer.

7. The process of claim 1, wherein the third anionic component comprises silica-based particles having an average particle size in the range of from 1 to 10 nm.

8. The process of claim 1, wherein the third anionic component comprises silica-based particles having a specific surface area of from 500 to 950 m2/g.

9. The process of claim 1, wherein the first anionic component is a water-soluble anionic acrylamide-based polymer obtained by polymerization of a monomer mixture comprising non-ionic monomers selected from the group consisting of acrylamide, methacrylamide, N-alkyl(meth)acrylamides, N-alkoxyalkyl(meth)acrylamides, N,N-dialkyl(meth)acrylamides, and mixtures thereof; and anionic monomers selected from the group consisting of ethylenically unsaturated carboxylic acids and salts thereof, ethylenically unsaturated sulphonic acids and salts thereof, paravinyl phenol and salts thereof, and mixtures thereof.

10. The process of claim 1, wherein the first anionic component is a water-soluble anionic acrylamide-based polymer obtained by polymerization of a monomer mixture comprising monomers selected from the group consisting of non-ionic monomers selected from the group consisting of acrylamide, methacrylamide, N-methyl (meth)acrylamide, N-ethyl(meth)acrylamide, N-n-propyl(meth)acrylamide, N-isopropyl(meth)acrylamide, N-n-butyl(meth)acrylamide, N-t-butyl(meth)acrylamide, N-isobutyl(meth)acrylamide, N-n-butoxymethyl(meth)acrylamide, N-isobutoxymethyl (meth)acrylamide, N,N-dimethyl(meth)acrylamide, N,N-dimethyl(meth)acrylamide, dialkylaminoalkyl(meth) acrylamides, and mixtures thereof; and anionic monomers selected from the group consisting of ethylenically unsaturated carboxylic acids and salts thereof, ethylenically unsaturated sulphonic acids and salts thereof, paravinyl phenol and salts thereof, and mixtures thereof.

11. The process of claim 1, wherein the first anionic component is a water-soluble Anionic acrylamide-based polymer obtained by polymerization of a monomer mixture comprising monomers selected from the group consisting of non-ionic monomers selected from the group consisting of acrylamide, methacrylamide, and mixtures thereof; and anionic monomers selected from the group consisting of ethylenically unsaturated carboxylic acids and salts thereof.

12. The process of claim 1, wherein the second anionic component is a water-dispersible or branched acrylamide-based polymer obtained by polymerization of a monomer mixture comprising polyfunctional crosslinking agents and monomers selected form the group consisting of anionic monomers selected from the group consisting of ethylenically unsaturated carboxylic acids and salts thereof, ethylenically unsaturated sulphonic acids and salts thereof, and mixtures thereof; and non-ionic monomers selected from the group consisting of acrylamide, methacrylamide, N-methyl (meth)acrylamide, N-ethyl(meth)acrylamide, N-n-propyl (meth)acrylamide, N-isopropyl(meth)acrylamide, N-n-butyl (meth)acrylamide, N-t-butyl(meth)acrylamide, N-isobutyl (meth)acrylamide, N-n-butoxymethyl(meth)acrylamide, N-isobutoxymethyl(meth)-acrylamide, N,N-dimethyl(meth) acrylamide, N,N-dimethyl(meth)acrylamide, dialkyl-aminoalkyl(meth)acrylamides, and mixtures thereof.

13. The process of claim 1, wherein the second anionic component is a water-dispersible or branched acrylamide-based polymer obtained by polymerization of a monomer mixture comprising polyfunctional crosslinking agents and monomers selected form the group consisting of non-ionic monomers selected from the group consisting of acrylamide, methacrylamide, and mixtures thereof; and anionic monomers selected from the group consisting of ethylenically unsaturated carboxylic acids and salts thereof.

14. A process for producing paper which comprises:

(i) providing an aqueous suspension comprising cellulosic fibres, (ii) adding to the suspension after the last point of high shear:

(a) a first anionic component which is a water-soluble anionic acrylamide-based polymer;

(b) a second anionic component which is a water-dispersible or branched acrylamide-based polymer;

(c) a third anionic component which is an anionic silica-based polymer comprising aggregated anionic silica-based particles having a specific surface area within the range of from 50 to 1000 m2/g;

(iii) dewatering the obtained suspension to form paper.

15. The process of claim 14, wherein the first anionic component has a molecular weight of at least 500,000.

16. The process of claim 14, wherein the silica-based particles are present in a sol having an S-value in the range of from 8 to 50%.

17. The process of claim 14, wherein the second anionic component has an Unswollen particle size less than 950 nm.

18. The process of claim 14, wherein the second anionic component is a water-dispersible and branched acrylamide-based polymer.

19. The process of claim 14, wherein the third anionic component comprises silica-based particles having an average particle size in the range of from 1 to 10 nm.

20. The process of claim 14, wherein the third anionic component comprises silica-based particles having a specific surface area of from 500 to 950 m2/g.

21. The process of claim 14, wherein the first anionic component is a water-soluble anionic acrylamide-based polymer obtained by polymerization of a monomer mixture comprising monomers selected from the group consisting of non-ionic monomers selected from the group consisting of acrylamide, methacrylamide, and mixtures thereof; and anionic monomers selected from the group consisting of ethylenically unsaturated carboxylic acids and salts thereof.

22. The process of claim 14, wherein the second anionic component is a water-dispersible or branched acrylamide-based polymer obtained by polymerization of a monomer mixture comprising polyfunctional crosslinking agents and monomers selected form the group consisting of non-ionic monomers selected from the group consisting of acrylamide, methacrylamide, and mixtures thereof; and anionic monomers selected from the group consisting of ethylenically unsaturated carboxylic acids and salts thereof.

* * * * *